US007651403B2

(12) United States Patent
Yamamoto et al.

(10) Patent No.: US 7,651,403 B2
(45) Date of Patent: Jan. 26, 2010

(54) METHOD OF SELECTING GOLF CLUB

(75) Inventors: Masaki Yamamoto, Kanagawa (JP); Hiroshi Saegusa, Kanagawa (JP); Masahiko Miyamoto, Kanagawa (JP); Masayoshi Kogawa, Kanagawa (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 552 days.

(21) Appl. No.: 11/253,596

(22) Filed: Oct. 20, 2005

(65) Prior Publication Data

US 2006/0111197 A1 May 25, 2006

(30) Foreign Application Priority Data

Oct. 20, 2004 (JP) ..... 2004-305642
Jul. 4, 2005 (JP) ..... 2005-194656

(51) Int. Cl.
*A63B 67/02* (2006.01)

(52) U.S. Cl. ..... 473/151; 473/407; 473/152; 473/198; 473/199

(58) Field of Classification Search ..... 473/407, 473/150–154, 198–199
See application file for complete search history.

(56) References Cited

U.S. PATENT DOCUMENTS 5,591,091 A * 1/1997 Hackman ..... 473/289
6,793,585 B1 9/2004 Miyamoto et al.
2003/0008731 A1* 1/2003 Anderson et al. ..... 473/407

FOREIGN PATENT DOCUMENTS

JP 2995617 10/1999
JP 2001-112903 * 4/2001
JP 2002-210055 7/2002

OTHER PUBLICATIONS

Office Action dated Mar. 4, 2008 issued in corresponding Japanese Application No. 2005-194656 with partial English translation.

* cited by examiner

*Primary Examiner*—Peter DungBa Vo
*Assistant Examiner*—Jasson H Yoo
(74) *Attorney, Agent, or Firm*—Finnegan, Henderson, Farabow, Garrett & Dunner, L.L.P.

(57) ABSTRACT

A golf club selecting method includes measuring a behavior of a golf club during a golf swing performed with the golf club gripped and selecting a golf club in accordance with the golf swing. At first, a swing information for characterizing the behavior of the gold club during the golf swing performed with the golf club gripped is acquired. Then a golf club is selected in accordance with the golf swing based on the acquired swing information, wherein the acquired swing information contains a movement speed at each of a plurality of predetermined positions which are different from each other on a golf club shaft axis of the golf club, and the movement speed is a speed in an impact state immediately before a golf ball is hit with the golf club.

4 Claims, 5 Drawing Sheets

METHOD OF SELECTING GOLF CLUB

BACKGROUND OF THE INVENTION

The present invention relates to a method of selecting a golf club fitting for each golfer, and more specifically, to a method of selecting a fitting golf club shaft.

DESCRIPTION OF RELATED ART

Conventionally, in order to obtain an exact flying direction of a golf ball and to increase a flying distance thereof, for example, considering static characteristics such as the length of a shaft of a golf club, the weight of the golf club, and the hardness of the shaft, various kinds of golf clubs have been produced.

When a golf club suitable for a user is to be selected (fitting of a golf club) from among various kinds of golf clubs, the selection of a golf club shaft mostly depends upon the long-term experience and guesswork of a person (fitter) selecting a golf club suitable for a user.

In general, for a golfer having a high head speed, a golf club shaft that is hard and is unlikely to bend is recommended, and for a golfer having a low head speed, a golf club shaft that is soft and bends to some degree is recommended.

However, recently, as the needs from users are becoming various, the conventional selection of a golf club shaft based on the head speed of a user is becoming insufficient.

Furthermore, in the case where the same golfer swings golf clubs having different weights and lengths, the head speed varies. Therefore, using a head speed as a standard of selecting a golf club is not objective enough.

Thus, various techniques of selecting a golf club while paying attention to the golf swing of each golfer have been proposed. According to these techniques, the golf swing is objectively analyzed and classified, and a golf club is selected in accordance with the classification.

As such a technique, a golf swing analysis apparatus capable of objectively analyzing a golf swing has been proposed (for example, see JP 2995617 B). In this golf swing analysis apparatus, two strain gauges are attached to a shaft portion of a golf club, and the swing of a golfer is classified using a graph in which the strain in a hit direction and the strain in an address direction are plotted on orthogonal coordinates, based on signals detected from the strain gauges.

In the above-mentioned golf swing analysis apparatus, the signal from the strain gauges are detected as time series data, and the swing of a golfer is classified based on the state of a change in a graph plotted on orthogonal coordinates. Thus, according to a method of classifying a swing based on the state of a change in a graph, the classification standard for classifying a swing is ambiguous, and a golf swing cannot be classified uniquely, so that it is difficult to select a golf club with sufficient objectivity.

SUMMARY OF THE INVENTION

The present invention has been made in view of the above problems, and its object is to provide a method of selecting a golf club fitting for each golfer objectively without depending upon a fitter.

The present invention provides a golf club selecting method of analyzing a behavior of a golf club during a golf swing performed with the golf club gripped, and selecting a golf club in accordance with the golf swing, comprising: a swing information acquiring step of acquiring swing information for characterizing the behavior of the golf club during the golf swing performed with the golf club gripped; and a golf club selecting step of selecting a golf club in accordance with the golf swing based on the acquired swing information, wherein the swing information acquired in the swing information acquiring step contains a movement speed at each of a plurality of predetermined positions which are different from each other on a golf club shaft axis of the golf club, and the movement speed is a movement speed in an impact state immediately before a golf ball is hit with the golf club.

The predetermined positions are preferably a grip position corresponding to a grip portion of the golf club, and a head position corresponding to a head portion of the golf club.

The golf club selecting step may include selecting a golf club having a golf club shaft of a kind fitting for the golf swing.

The golf club selecting step may include selecting a golf club having a golf club shaft with characteristics determined in accordance with the golf swing, as the golf club having the golf club shaft of the kind fitting for the golf swing.

The characteristics determined in accordance with the golf swing preferably comprises a kind of a kick point of. the golf club shaft.

It is preferable that the selecting step includes selecting a golf club having a golf club shaft of a kick point in accordance with the golf swing from a plurality of golf clubs having golf club shafts of different kick points based on a predetermined determination value; the predetermined determination value is obtained by dividing a movement speed of the head position in the impact state by a movement speed of the grip position; as the predetermined determination value becomes larger, a golf club having a golf club shaft of a lower kick point is selected from the plurality of golf clubs, and as the predetermined determination value becomes smaller, a golf club having a golf club shaft of a higher kick point is selected from the plurality of golf clubs.

It is also preferable that the swing information acquiring step includes calculating a movement speed of the head position in the impact state based on time series data of a position of a grip end of the golf club; and the time series data of the grip end is time series data in the golf swing of three-dimensional position coordinates of the grip end, and time series data of an orientation direction in the golf swing.

It is more preferable that the time series data of the grip end is obtained from a signal output from a three-dimensional magnetic sensor by forming a magnetic field with a known distribution regarding an intensity and a direction within a movement range in the golf swing of the grip end, wherein the three-dimensional magnetic sensor is fixed at the grip end of the golf club for sensing magnetism in the magnetic field and for outputting a signal in accordance with a three-dimensional position with respect to a predetermined reference position and a direction with respect to a predetermined reference direction when the golf swing is performed using the golf club in the formed magnetic field.

Alternatively, it is preferable that the movement speed of the grip position in the impact state and the movement speed of the head position in the impact state are respectively calculated based on movement speeds of measurement positions in the impact state obtained by measuring movement speeds in the impact state at two measurement positions placed between the grip position and the head position on a shaft of the golf club.

When it is assumed that an interval distance of the two measurement positions on the shaft of the golf club is L, a distance from one measurement position on the grip position side of the two measurement positions to the grip position is l, an interval distance between the grip position and the head position is H, a movement speed in the impact state at the one measurement position is Va, and a movement speed in the impact state at the other measurement position is Vb, a movement speed Vg in the impact state at the grip position may be calculated using the following Expression (1), and a movement speed Vh in the impact state at the head position may be calculated using the following Expression (2):

$$V_g=\{(L+1)\times V_a-1\times V_b\}/L \quad (1)$$

$$V_h=\{(L+1-H)\times V_a+(H-1)\times V_b\}/L \quad (2)$$

The swing information acquiring step may include acquiring the swing information based on an image obtained by capturing the golf swing.

The present invention provides a golf club selecting method of analyzing a behavior of a golf club during a golf swing performed with the golf club gripped, and selecting a golf club in accordance with the golf swing, comprising: a swing information acquiring step of acquiring swing information for characterizing the behavior of a golf club during the golf swing performed with the golf club gripped; and a golf club selecting step of selecting a golf club in accordance with the golf swing based on the acquired swing information, wherein the swing information acquired in the swing information acquiring step contains a movement speed of a grip end of the golf club, and the movement speed is a movement speed in an impact state immediately before a golf ball is hit with the golf club.

It is preferable that the swing information acquiring step includes acquiring time series data on a speed of the grip end of the golf club in a period from a top state to an impact state of the golf swing, and the swing information which is used for selecting a golf club contains, assuming that a maximum speed of the grip end of the golf club is Vmax among the time series data acquired in the swing information acquiring step, an average acceleration of the grip end in a period from the top state to a state where the speed of the grip end reaches Vmax, and an average acceleration of the grip end in a period from the state where the speed of the grip end reaches Vmax to the impact state.

Then it is more preferable that the swing information acquiring step includes acquiring time series movement speed information in the golf swing of the grip end, using time series data on three-dimensional position coordinates of the grip end in the golf swing, the time series data being obtained from a signal output from a three-dimensional magnetic sensor by forming a magnetic field with known a distribution regarding an intensity and a direction in a movement range in the golf swing of the grip end, wherein the three-dimensional magnetic sensor is fixed at the grip end of the golf club for sensing magnetism in the magnetic field and for outputting a signal in accordance with a three-dimensional position with respect to a predetermined reference position and a direction with respect to a predetermined reference direction when the golf swing is performed using the golf club in the formed magnetic field.

Alternatively the swing information acquiring step preferably includes acquiring the swing information based on an image obtained by capturing the golf swing.

In the present invention, a golf club fitting for a golf swing is selected based on information containing the speed of a grip end of a golf club in an impact state immediately before a golf ball is hit. Thus, according to the present invention, a method of objectively selecting a golf club fitting for each golfer can be provided.

DETAILED DESCRIPTION OF THE INVENTION

A method of selecting a golf club will be described in detail by way of an embodiment in which a method of selecting a golf club according to the present invention is applied to a golf club analysis system.

Figure 1:
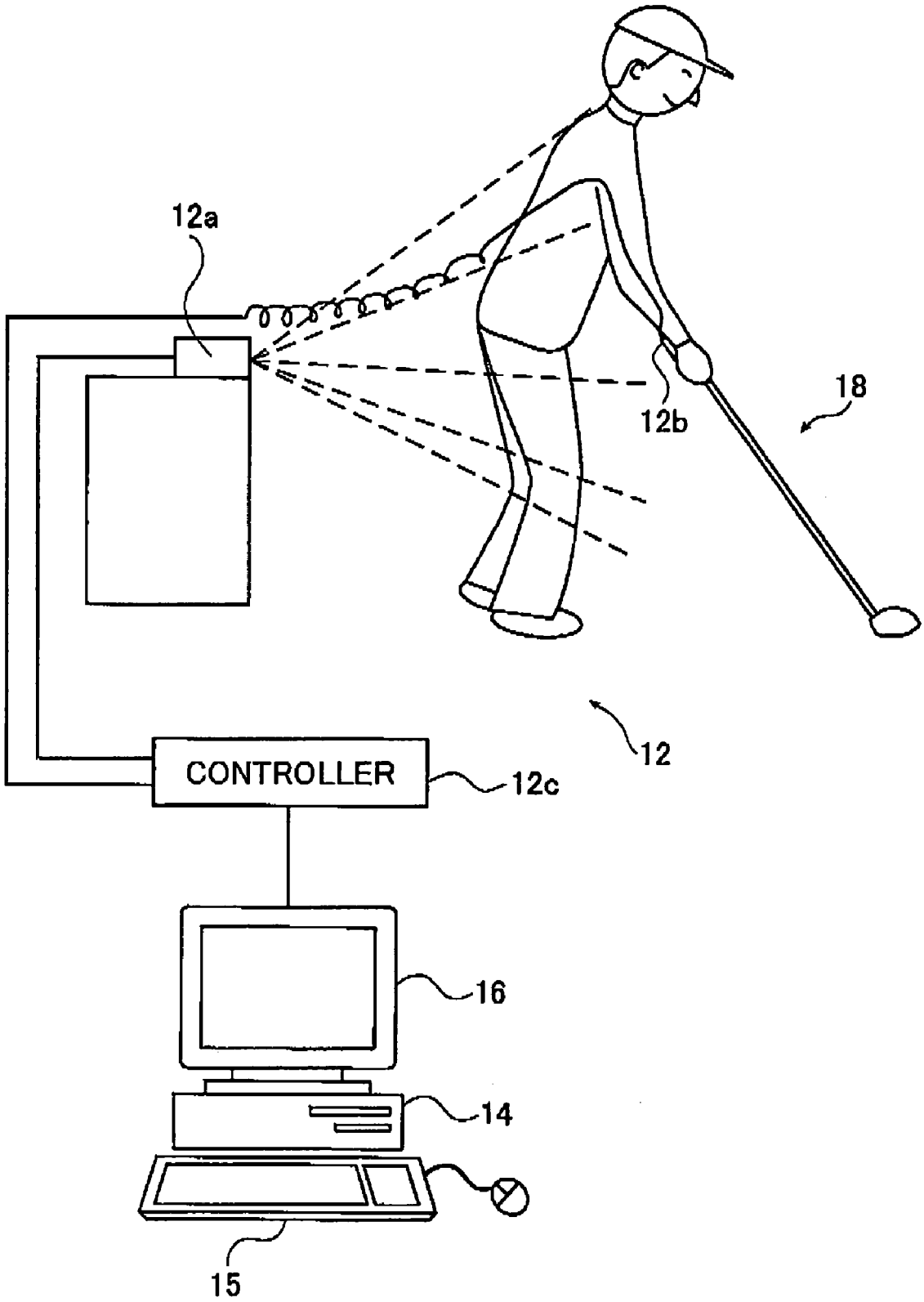
FIG. 1 is a configuration diagram schematically showing a golf swing analysis system.

FIG. 1 is a configuration diagram schematically showing a golf swing analysis system. The golf swing analysis system of this embodiment is realized by a three-dimensional position direction measurement apparatus 12, a processing apparatus 14, an operation apparatus 15, and a display apparatus 16. Information obtained by measuring a golf club 18 during a golf swing with the three-dimensional position direction measurement apparatus 12 is analyzed, and information (hereinafter, referred to as golf club selection information) for selecting a golf club and various kinds of menus for a user to input information to the processing apparatus 14 are displayed on a screen of the display apparatus 16.

The three-dimensional position direction measurement apparatus 12 uses a magnetic sensor to measure 6 degree of freedom (6DOF) of three-dimensional position coordinates (X, Y, Z) and Euler angles (Pitch, Yaw, Roll; posture angle). The three-dimensional position direction measurement apparatus 12 includes a transmitter 12*a*, a receiver (magnetic sensor) 12*b*, and a controller 12*c*.

The transmitter 12*a* forms a magnetic field having a distribution in which the intensity and direction are known in a predetermined range. The receiver 12*b* is fixed at an evaluation position (grip position) corresponding to a grip portion of the golf club 18 on a virtual line passing through a shaft center axis of the golf club 18. The receiver 12*b* senses a magnetic field, thereby outputting a signal containing three-dimensional positions of a grip position with respect to a reference position, and information on an Euler angle of the shaft center axis of the golf club 18 at which the receiver 12*b* is fixed.

The controller 12*c* generates time series data on the grip position in a three-dimensional space and time series data on a direction, based on the signal. For example, the controller 12*c* generates time series data on three-dimensional position coordinates (hereinafter, referred to as three-dimensional positions ($x_m$, $y_m$, $z_m$)) with the position of the transmitter 12*a* being a reference position and three axes X, Y, Z orthogonal to each other being a standard direction, and time series data on posture angles (hereinafter, referred to as Euler angles ($\theta_y$, $\theta_p$, $\theta_r$)) representing the orientation direction of the receiver 12*b* with respect to a Y-axis direction, an origin of the Y-axis set at the position of the transmitter 12*a*.

As shown in FIG. 1, the measurement apparatus 12 successively generates three kinds of predetermined magnetic fields from the transmitter 12*a* fixed behind a golfer who swings. On the other hand, the receiver 12*b* fixed at a grip position (grip end), which moves and rotates, senses magnetism corresponding to the position and the direction in three kinds of magnetic fields formed by the transmitter 12*a*, and outputs 9 (in total) output voltages to the controller 12*c*. The controller 12*c* subjects the output voltages to data processing, and can obtain data on the position and the direction (Euler angle) of the receiver 12*b* in the three-dimensional space.

In this embodiment, the receiver 12*b* is fixed at one portion (the above-mentioned evaluation position) of the grip end of the golf club 18, and obtains data on the three-dimensional positions and directions at the grip position. The receiver 12*b* is fixed at the grip end of the golf club 18 so that time series data on the three-dimensional position coordinates of the grip position and time series data on its posture angle can be obtained.

The golf club 18 is a predetermined golf club with standard specifications, for example, having a length of 1066 to 1219 mm (about 42 to about 48 inches), a frequency of 3.3 to 5.0 Hz (200 to 300 cpm), and a mass of 280 to 320 g.

The processing apparatus 14 processes the time series data on the three-dimensional positions ($x_m$, $y_m$, $x_m$) at the evaluation position (grip position) of the grip end and the time series data on the Euler angles ($\theta_y$, $\theta_p$, $\theta_r$) measured by the three-dimensional position direction measurement apparatus 12, and calculates time series movement speeds with respect to two evaluation positions on the shaft center axis of the golf club 18 during a golf swing. Then, the processing apparatus 14 extracts the movement speeds at the above-mentioned evaluation positions in an address, a top, an impact, and a finish that are particular states during a golf swing, from the respective calculated time series movement speed histories at the two evaluation positions. Herein, one of the two evaluation positions in the golf club 18 is positioned at the grip end of the golf club 18 (the above-mentioned grip position). Furthermore, the other evaluation position among the two evaluation positions is away from the grip end (grip position) by a predetermined distance along the shaft center axis (head position) on the virtual line passing on the shaft center axis of the golf club 18. In this embodiment, a head position is away from the grip end by 1143 mm (about 45 inches) along the shaft axis. More specifically, the other. evaluation position (head position) among the two evaluation positions is placed in a portion corresponding to the golf club head of the golf club 18, in the case where the golf club 18 has a golf club head with a shaft length of 45 inches.

The interval (1143 mm in this embodiment) of the two evaluation positions (grip position and head position) are known, and stored in a memory (described later) of the processing apparatus 14. The processing apparatus 14 calculates respective time series movement speed histories during a golf swing at the grip position and the head position. In the present invention, the head position may be set at an arbitrary position away from the grip end (grip position) to-the golf club head by 700 mm or more, preferably 863 mm (about 34 inches) or more along the golf club shaft axis.

Among the two evaluation positions, the time series movement speed at the grip position is directly derived from the time series data on the three-dimensional positions ($x_m$, $y_m$, $z_m$) at the grip position obtained by the receiver 12*b*. Furthermore, the head position is a point on the virtual line passing through the shaft center axis of the golf club 18, away from the grip position by the above-mentioned interval (known interval: 1143 mm) as described above, and the time series position information at the head position can be derived from the time series data on the three-dimensional positions ($x_m$, $y_m$, $z_m$) at a measurement point of the grip end and the time series data on the Euler angles ($\theta_y$, $\theta_p$, $\theta_r$). The time series speed information at the head position is calculated as follows: first, the time series position information on the head position is obtained, and the time series speed information at the head position is calculated from the time series position information.

The processing apparatus 14 includes a central processing unit (CPU) executing various kinds of operation processings and controlling each portion, a processing program that functions as a work area of the CPU and is executed by the CPU, and a memory storing processing results of the processing program executed by the CPU, various kinds of data, and the like, and the CPU and the memory are connected to each other via a bus.

Examples of the memory include a semiconductor memory device such as a dynamic random access memory (DRAM) storing information, a static random access memory (SRAM) constituting a memory with a logic circuit without using a capacitor, and a non-volatile read only memory dedicated for reading, which stores a program and the like executed by the CPU, a magnetic disk such as a flexible disk, and an optical disk such as a CD and a DVD.

Furthermore, the processing apparatus 14 is connected to the three-dimensional position direction measurement apparatus 12, the operation apparatus 15, and the display apparatus 16 via an I/O interface, and exchanges data among them.

The operation apparatus 15 allows various kinds of menus displayed on the display apparatus 16 to be selected, and inputs the information to the processing apparatus 14. Representative examples of the operation apparatus 15 include a keyboard and a mouse.

The display apparatus 16 displays various kinds of menu buttons and the like to accelerate a user to input, and displays various kinds of data processed by the processing apparatus 14 on a screen in the form that enables the user to analyze a golf swing easily. Representative examples of the display apparatus 16 include an LCD, a PDP, and a CRT.

It is preferable that, on the screen displayed by the display apparatus 16, the speed history of a golf club head and a grip end are displayed as golf club selection information.

The speed history is a speed change at the evaluation position of a golf club that is swung. The speed history of the golf club head is a speed history at the evaluation position (head position) of the golf club head, and the speed history of the grip end is a speed history at the evaluation position (grip position) of a tip end of the grip.

Thus, the speed history of the golf club head and the speed history of the grip end are displayed simultaneously, whereby the user can analyze the golf swing from various angles.

Accordingly, in selecting a golf club suitable for a golfer, the golf club is selected considering the speed history of the grip end, as well as the speed history of the golf club head, so that a golf club fitting for each golfer can be selected objectively.

The three-dimensional position direction measurement apparatus will be described in detail with reference to FIG. 2.

Figure 2:
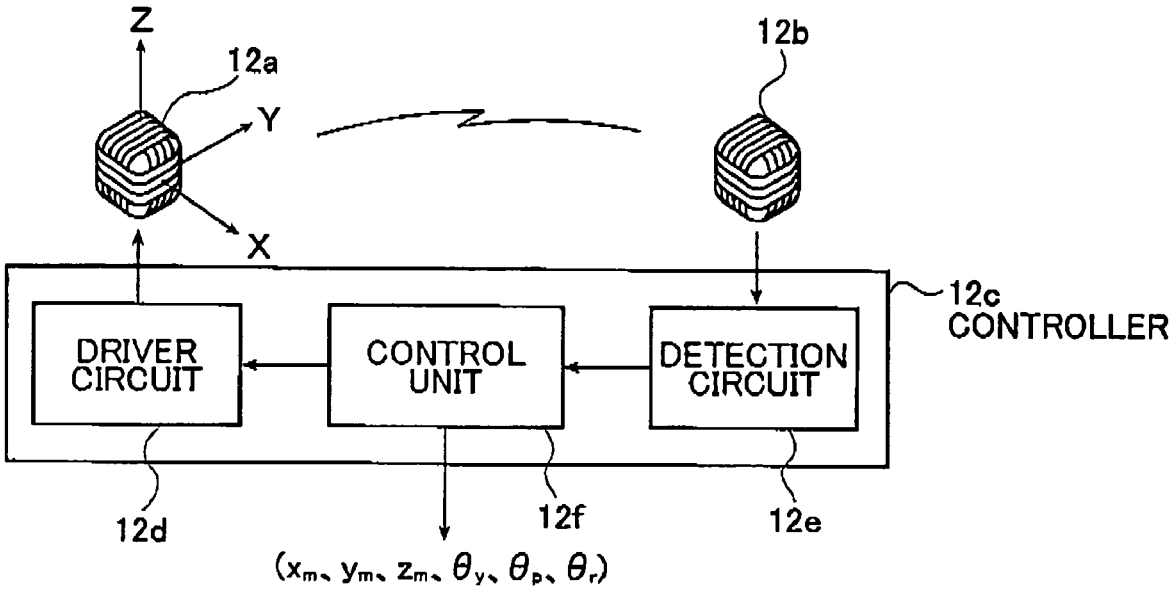
FIG. 2 is a block diagram of a three-dimensional position direction measurement apparatus.

FIG. 2 is an exemplary block diagram of the three-dimensional position direction measurement apparatus 12.

As described above, the three-dimensional direction measurement apparatus 12 includes the transmitter 12*a* forming a predetermined magnetic field, the receiver 12*b* generating output voltages in three-axis directions in accordance with the intensity and direction of the magnetic field, and the controller 12*c*.

The controller 12*c* is composed of a driving circuit 12*d* generating a driving signal that successively generates three kinds of magnetic fields, a detection circuit 12*e* detecting a signal output from the receiver 12*b*, and a control unit 12*f* controlling the driving circuit 12*d* and the detection circuit 12*e*, and obtaining the three-dimensional position and the Euler angles of the receiver 12*b* based on the signal transmitted from the detection circuit 124.

The controller 12*c* generates a driving signal that successively generates three kinds of predetermined magnetic fields to the transmitter 12*a*, and detects a signal output from the receiver 12*b*.

Furthermore, the controller 12*c* performs data processing based on the detected signal, and calculates time series data on the evaluation position (grip position) at which the receiver 12*b* is fixed, and time series data on the direction thereof.

The time series data on the grip position is time series data on the three-dimensional positions ($x_m$, $y_m$, $z_m$) of the receiver 12*b* with the position of the transmitter 12*a* being a reference position and three axes X, Y, Z orthogonal to each other being the standard direction, and the time series data on the direction is time series data on the posture angles representing the directions of the receiver 12*b* with respect to the X, Y, Z coordinate axis directions, i.e., the Euler angles ($\theta_y$, $\theta_p$, $\theta_r$) represented by a yaw angle, a pitch angle and a roll angle.

As shown in FIG. 2, the transmitter 12*a* and the receiver 12*b* are composed of three coils wound respectively in a loop shape in three axis directions orthogonal to each other.

The transmitter 12*a* is placed behind a golfer who swings, and the receiver 12*b* is fixed to the golf club 18. Furthermore, the transmitter 12*a* is connected to the driving circuit 12*d*, and the receiver 12*b* is connected to the detection circuit 12*e*, respectively.

A method of obtaining time series data on the positions ($x_m$, $y_m$, $z_m$) of the receiver 12*b* and the directions ($\theta_y$, $\theta_p$, $\theta_r$) thereof, by performing data processing based on the detected signal, will be described in detail.

The driving circuit 12*d* outputs the same signal with the frequency and the phase being constant at all times in accordance with an instruction signal of the control unit 12*f*, and successively excites three loop-shaped coils wound in three axis directions of the transmitter 12*a*.

Each loop-shaped coil generates a magnetic field varied for each excitation, and each excitation allows three loop-shaped coils wound in three axis directions of the receiver 12*b* to generate voltages independent from each other based on the magnetic field. These voltages are three independent voltages generated in three loop-shaped coils of the receiver 12*b* in accordance with the respective three magnetic fields excited by three loop-shaped coils of the transmitter 12*a*, so that in total 9 (3×3) voltages are obtained.

On the other hand, the transmitter 12*a* forming a magnetic field is fixed at a predetermined position, so that the distribution regarding the intensity of a generated magnetic field and the direction thereof can be defined fixedly and caluculated.

The control unit 12*f* uses 9 voltages sent from the detection circuit 12*e* to obtain data on the three-dimensional positions ($x_m$, $y_m$, $z_m$) and the Euler angles ($\theta_y$, $\theta_p$, $\theta_r$)

Thus, by using 9 voltages generated in the formed magnetic field, the three-dimensional positions ($x_m$, $y_m$, $z_m$) of the receiver 12*b* with respect to the above-mentioned reference position and the Euler angles ($\theta_y$, $\theta_p$, $\theta_r$) with respect to the above-mentioned reference direction can be obtained. More specifically, the three-dimensional positions ($x_m$, $y_m$, $z_m$) at the grip position where the receiver 12*b* is fixed and the Euler angles ($\theta_y$, $\theta_p$, $\theta_r$) can be obtained. Data on the three-dimensional positions ($x_m$, $y_m$, $z_m$) and the Euler angles ($\theta_y$, $\theta_p$, $\theta_r$) obtained in the three-dimensional position direction measurement apparatus 12 is sent to the processing apparatus 14.

In this embodiment, as shown in FIG. 2, the receiver 12*b* is wound with a coil in a loop shape in three axis directions orthogonal to each other. Therefore, the direction of the receiver 12*b* is determined so that one of the three axis directions is adjusted in the axis direction of the golf club shaft 19, and one of the remaining two axis directions is adjusted in the hit direction of the golf club, whereby the receiver 12*b* is fixed at the grip position of the golf club 18.

An example of the three-dimensional position direction measurement apparatus 12 includes a 3SPACE FASTRACK (produced by Polhemus)

Figure 3:
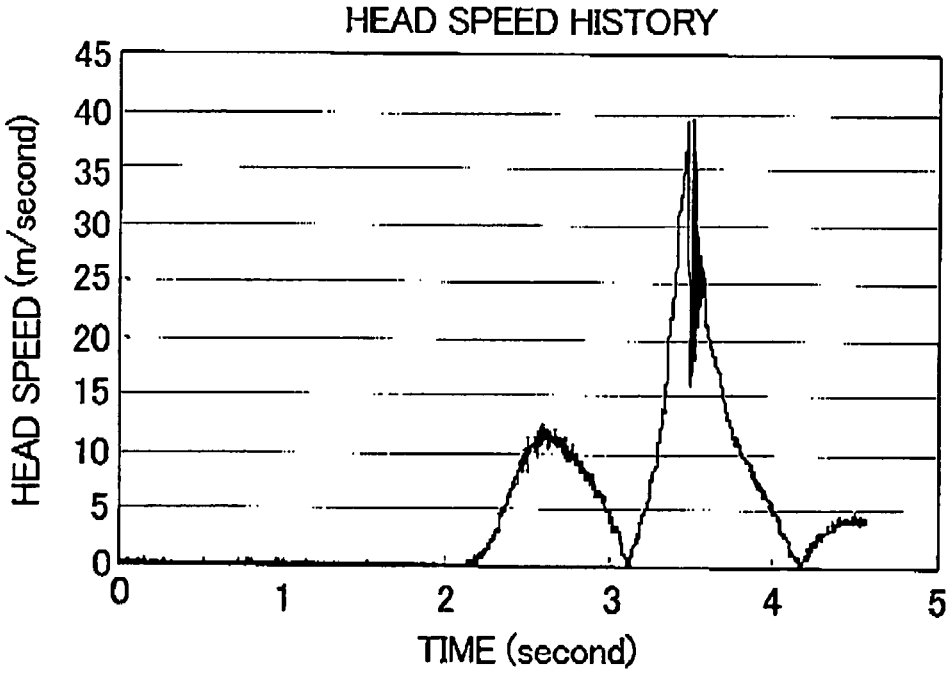
FIG. 3 shows a speed history of a golf club during a golf swing.

A method of calculating the speed history of a golf club showing a relationship between the speed and the swing time of the golf club will be described. FIG. 3 shows a movement speed history (head speed history) of a head position of the golf club during a golf swing. More specifically, FIG. 3 shows a head speed history obtained as follows: time series position information on the evaluation position (head position) of a golf club head away from the grip position by 1143 mm along the shaft axis is first obtained from the time series data on the three-dimensional positions ($x_m$, $y_m$, $z_m$) and the time series data on the Euler angles ($\theta_y$, $\theta_p$, $\theta_r$), and a head speed history is calculated from the time series position information.

The processing apparatus 14 obtains the time series data on the three-dimensional positions ($x_m$, $y_m$, $z_m$) and the time series data on the Euler angles ($\theta_y$, $\theta_p$, $\theta_r$) measured by the three-dimensional position direction measurement apparatus, through the receiver fixed at the grip position of the golf club. Then, three-dimensional positions ($x(t_n)$, $y(t_n)$, $z(t_n)$) of the head position of the golf club at a swing time $t_n$ (n=1–N, where N is the number of time series data during a golf swing) is obtained based on the time series data, and a head speed $V_c$ ($t_n$) is calculated using the following Expression (3).

$$V_c(t_n) = \frac{\sqrt{(x(t_n) - x(t_{n-1}))^2 + (y(t_n) - y(t_{n-1}))^2 + (z(t_n) - z(t_{n-1}))^2}}{t_n - t_{n-1}} \quad (3)$$

The speed $V_c$ ($t_n$) of the head position of the golf club calculated using the above-mentioned Expression (3) is plotted with the club speed being taken on a vertical axis and the swing time being taken on a horizontal axis, whereby the head speed history can be obtained.

In the head speed history of the golf club shown in FIG. 3, the takeback starts after the elapse of two seconds, and a top state is taken after the elapse of about 3.1 seconds. Then, the downswing starts. After the elapse of 3.4 seconds, the head speed becomes maximum immediately before the impact, and after the elapse of 4.2 seconds, a finish state is taken.

Although a golf swing varies widely depending upon a golfer, most golfers perform a golf swing in the following procedure.

In an address state, a golfer is at the ready, gripping a golf club, and the golf club is kept in a stationary state.

A golfer performs a backswing by twisting and rotating the body with respect to a certain axis, and performs a downswing through the top state so that the twisted body is returned to a normal posture.

The golfer who has performed a downswing hits a golf ball with a golf club in an impact state, and the golf ball flies in a desired direction. The golfer gives large energy to the golf ball by hitting it so as to attempt to increase the flying distance of the golf ball, so that the club speed becomes maximum in the vicinity of the impact state.

The club speed decreases after the impact state, and the golf club becomes stationary or almost stationary in a finish state.

In order to increase the flying distance of the golf ball and obtain an exact flying direction thereof during such a series of operations, the behavior of the golf club from the state before the impact state, in particular, the top state to the impact state is important. The behavior of the golf club is largely influenced by the movement speed (head speed) of the head position of the golf club in the impact state and the movement speed (grip speed) of the grip position. The movement speed (head speed) of the head position of the golf club in the impact state and the movement speed (grip speed) of the grip position vary for each swing of a golfer. The present invention provides a method of selecting a golf club by obtaining feature values representing the behavior of the golf club during a golf swing, using the movement speed of the head position of the golf club in the impact state and the movement speed of the grip position thereof, thereby selecting a golf club suitable for each golfer.

An exemplary method of selecting a golf club using the speed histories of the head and the grip end of the golf club will be described with reference to FIGS. 4 and 5.

Figure 4:
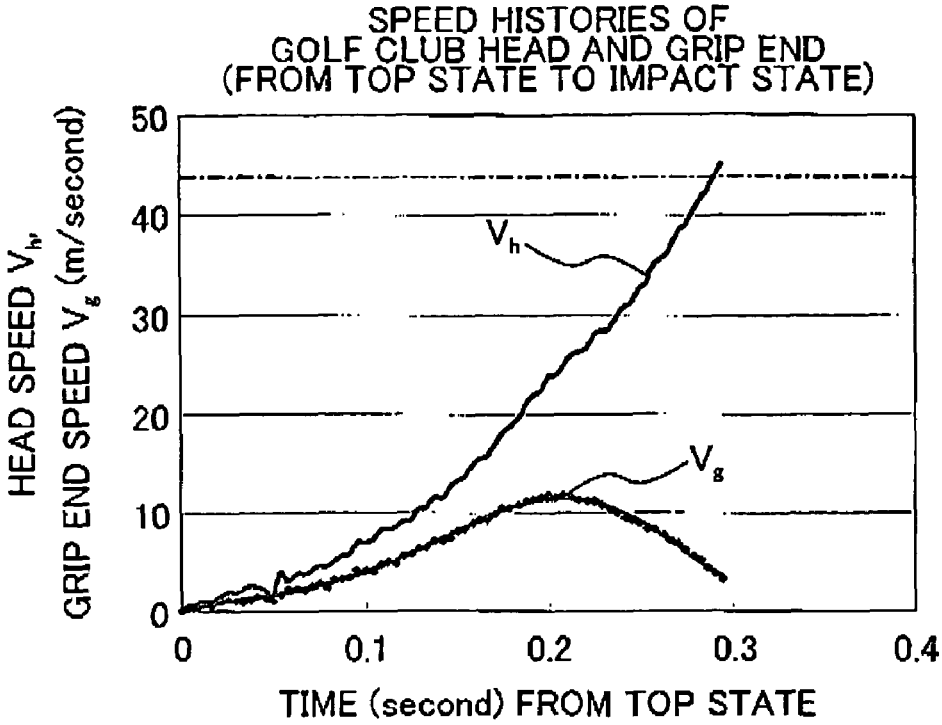
FIG. 4 shows an example of a speed history of a golf club head and a grip end from a top state to an impact state.

FIG. 4 shows an example of the speed histories of the head (head position) and the grip end (grip position) of the golf club from the top state to the impact state. FIG. 5 shows an example of speed histories of the head (head position) and the grip end (grip position) of the golf club, regarding the case of a golf swing in which a head speed is substantially equal immediately before the impact (impact state) shown in FIG. 4.

In the golf swing shown in FIG. 4, the speed of the golf club head (head position) increases with a swing time, and becomes maximum immediately before the impact (impact state). On the other hand, the speed of the grip end gradually increases with a swing time to become maximum, and thereafter, decreases.

Figure 5:
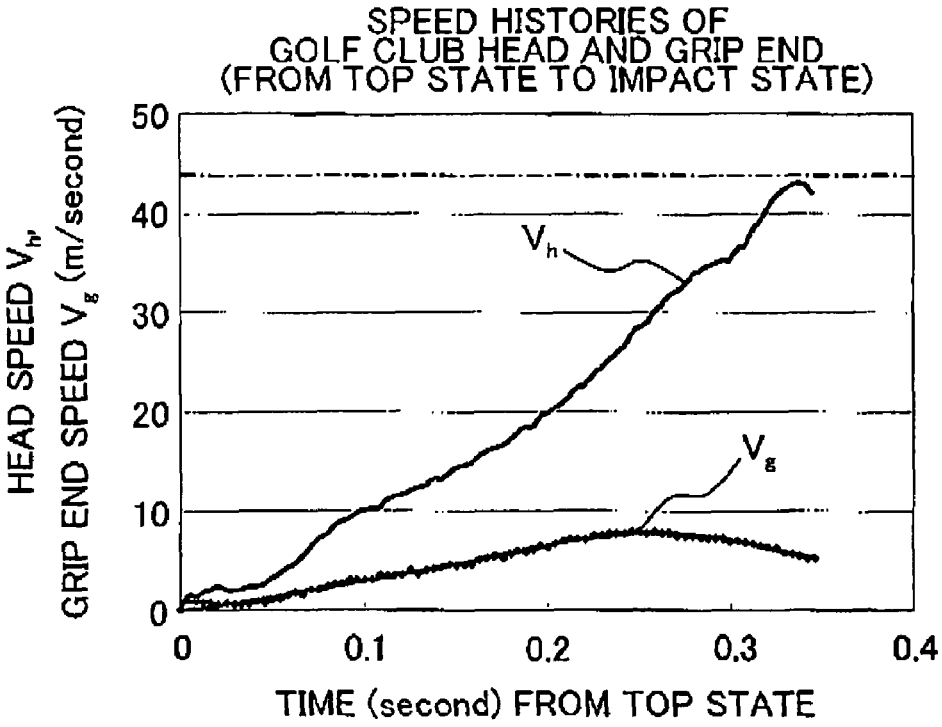
FIG. 5 shows an example of a speed history of a golf club head and a grip end from a top state to an impact state.

In the golf swing shown in FIG. 5, the speed of the golf club head increases with a swing time, and becomes maximum immediately before the impact (impact state) as the golf swing shown in FIG. 4. On the other hand, the speed of the grip end increases with a swing time to become maximum, and thereafter, decreases.

However, in the speed histories shown in FIG. 4, the maximum speed of the grip end is 10.2 m/s, while in the speed histories shown in FIG. 5, the maximum speed of the grip end is 8 m/s. Furthermore, in the speed histories shown in FIG. 4, the time at which the speed of the grip end becomes maximum is after the elapse of 0.2 seconds from the top state, while in the speed histories shown in FIG. 5, the time at which the speed of the grip end becomes maximum is after the elapse of 0.25 seconds from the top state.

Thus, it is understood that the speed history of the grip end varies largely even from the comparison of golf swings in which the head speed immediately before the impact is substantially equal.

Then, the inventors of the present invention have found that the grip end speed as well as the head speed during a golf swing can also be used as an index for characterizing the golf swing of a golfer.

In order to show that the grip end speed can be used as an index for characterizing the golf swing of a golfer, the influence of the difference in the grip end speed on a golf club shaft will be described.

Figure 6:
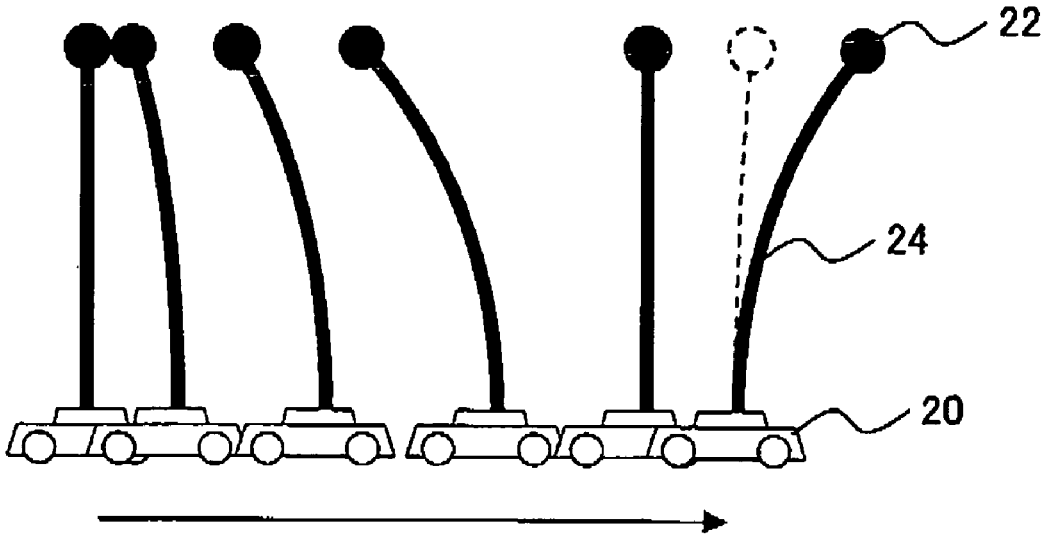
FIG. 6 is a schematic diagram explaining the influence of the difference in a grip end speed on a golf club shaft.
Figure 7:
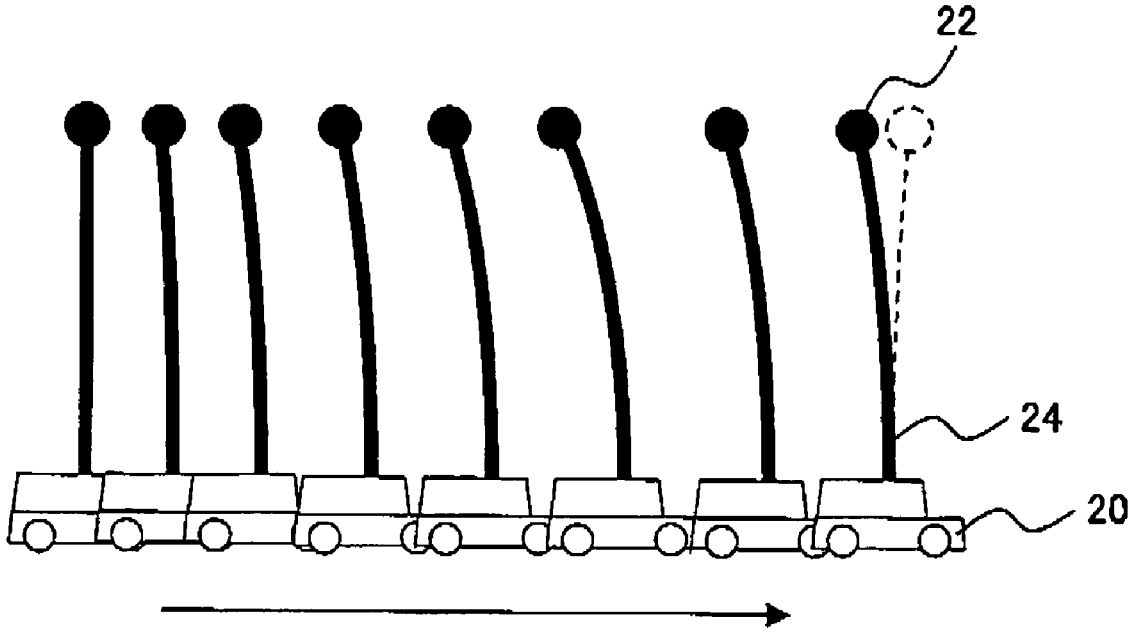
FIG. 7 is a schematic diagram explaining the influence of the difference in a grip end speed on a golf club shaft.

FIGS. 6 and 7 schematically show the influence of the difference in the grip end speed on a golf club shaft.

FIG. 6 shows the state of a change in a ball 22 corresponding to a golf club head in the case where a block 20 corresponding to a grip end is moved by giving a relatively large acceleration change. A pole 24 is a portion corresponding to a golf club shaft, and bends with a magnitude in accordance with the acceleration when the block is moved in the same way as in the golf club shaft.

In FIG. 6, the block 20 moves in an arrow direction. In the case of FIG. 6, during movement, the movement speed of the block 20 increases relatively largely (accelerates with a relatively large acceleration (absolute value)) after starting movement, and decreases relatively largely (decelerates with a relatively large acceleration (absolute value)). At a time of the commencement of movement, the block 20 stops in the same way as in the top state of a golf swing. When the block 20 starts moving, the pole 24 bends in accordance with the acceleration. When the movement speed of the block 20 decelerates, the pole 24 returns to an original position, and then, bends on a side opposite to the direction in which the pole 24 has been bent.

In the case of a golf swing, a golf ball can be fired farther by using sufficiently the bending of a golf club shaft. Therefore, it is preferable that a golf ball be hit at a position where the golf club shaft is in a state represented by a dotted line in FIGS. 6 and 7.

FIG. 7 shows the state of a change in a ball 22 corresponding to a golf club head in the case where a block 20 corresponding to a grip end is moved by giving a relatively large acceleration change. A pole 24 is a portion corresponding to a golf club shaft, and bends with a magnitude in accordance with the acceleration when the block is moved in the same way as in the golf club shaft.

In FIG. 7, the block 20 is stopped at the starting point of the movement as shown in FIG. 6 and moves in an arrow direction. In the case of FIG. 7, during movement, the movement speed of the block 20 increases relatively small (accelerates with a relatively small acceleration (absolute value)) after starting movement, and decreases relatively small (decelerates with a relatively small acceleration (absolute value)).

When FIG. 6 is compared with FIG. 7, it is understood that, in accordance with the difference in the movement speed history of the block 20, the bending of the pole 24 varies largely, and the position represented by a dotted line in FIGS. 6 and 7, i.e., the position (i.e., timing) of a preferable state for hitting a golf ball during a golf swing varies. More specifically, it is understood that, in accordance with the difference in the movement speed history of the grip end during a golf swing, the bending of the golf club shaft varies, and the timing desirable for hitting a golf ball during a golf swing varies. The movement speed history of the grip end during a golf swing is considered to characterize the behavior of a golf club during a golf swing.

It is known that the golf club shaft bends during a golf swing, and the flying distance of a golf ball hit with a golf club generally increases when the bending of the golf club shaft is sufficiently used.

At a time of an impact of the golf ball, the golf club shaft bends in a direction of launching the golf ball. The launch angle, which is an angle at which the golf ball is launched from a face at a time of an impact, is an important element for determining the path and flying distance of the golf ball. The launch angle varies depending upon the bending of the golf club shaft during a golf swing. The change in the launch angle of the golf ball becomes a factor influencing the height of the path of the golf ball and the flying distance thereof.

Even when each of a plurality of golfers grips the same golf club and performs a golf swing, the bending of the golf club shaft varies for a swing of each golfer, and a preferable timing for hitting a golf ball during a golf swing and a preferable launch angle for hitting a golf ball also vary.

Conventionally, a golf club shaft is selected based on the long-term experience and guesswork of a fitter, in accordance with the swing characteristics of each golfer, such as the pace of a golf swing, the head speed at a time of an impact, a wrist action, a weight shift, and a physical condition.

There are various kinds of golf club shafts to be selected, in accordance with the position of a kick point representing a portion of a golf club shaft that bends, the flex that is an index representing the stoffness of the golf club shaft, the torque that is an index representing the degree of twist of the golf club shaft, and the like.

There are three kinds of positions of a kick point (hereinafter, referred to as kick point positions): a kick point Low, a kick point Mid, and a kick point High.

Regarding the golf club shaft at the kick point Low, the kick point is positioned on a relatively golf club head side, and the golf club head side of the golf club shaft bends most. Furthermore, regarding the golf club shaft at the kick point High, the kick point is positioned on a relatively golf club grip side, and a portion close to a grip of the golf club shaft bends most. Regarding the golf club shaft at a kick point Mid, the vicinity of an intermediate point between the position of a kick point of the golf club shaft at the kick point Low and the position of a kick point of the golf club shaft at the kick point High bends the most.

The kick point position influences the bending of the golf club shaft during a golf swing. More specifically, even with the same golf swing performed by the same golfer, when the kick point position of the golf club shaft varies, the timing desirable for hitting a golf ball during a golf swing vary. Such a difference (difference in a timing and a launch angle desirable for hitting a golf ball) largely influences, for example, the feeling (hit feeling) felt by a golfer when the golfer hits a golf ball by a golf swing.

In accordance with the above view, the inventors of the present invention confirmed by way of the following examples that the head speed and the grip end speed can be used as basic measures for determining the appropriate position of a kick point during a golf shaft.

Embodiment 1

Figure 8:
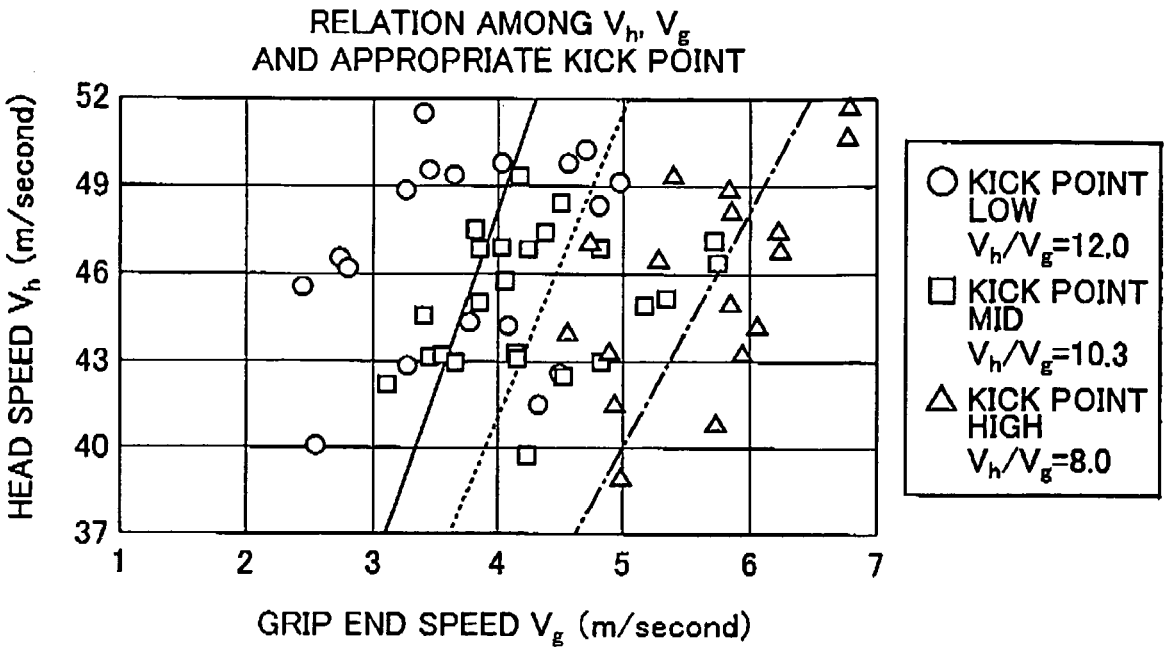
FIG. 8 shows a relationship among a head speed, a grip speed, and an appropriate kick point at an impact.

FIG. 8 is a diagram showing a relationship among a head speed, a grip speed, and an appropriate kick point at a time of an impact. A plurality of golfers having different head speeds when swinging a golf club were allowed to swing a golf club that serves as the reference, and a head speed $V_h$ and a grip end speed $V_g$ at a time of an impact of each golfer were measured. Then, a relationship between the head speed $V_h$ and the grip end speed $V_g$ was plotted as shown in FIG. 8. Furthermore, the plurality of golfers were allowed to swing a plurality of golf club shafts having different kinds of kick points, and each golfer was allowed to select a golf club having a kick point at which feeling (hit feeling) felt by the golfer when the golfer hit a golf ball by a golf swing was most preferable. Then, plot points were classified in accordance with the kind of the kick point selected by the golfer based on the feeling.

As a golf club with which a golfer gripped and swung when the above-mentioned head speed $V_h$ and the grip end speed $V_g$ were measured, a predetermined golf club with a standard specification was used, which had a length in a golf club shaft of 1066 to 1219 mm (about 42 to about 48 inches), a vibration number of 3.3 to 5.0 Hz (200 to 300 cpm), and a mass of 280 to 320 g.

Specifically, each of a plurality of golfers gripped and swung three kinds of golf clubs having different kick point positions of a golf club shaft. Then, each golfer selected a golf club with which the feeling (hit feeling) felt by the golfer when the golfer hit a golf ball by a golf swing was most preferable. The three kinds of golf clubs are different from each other in a kick point position of a golf club shaft.

More specifically, the three kinds of golf club shafts are different from each other in a kick point position which is defined as a position of a maximum bending point of a golf club shaft under the condition that the maximum bending amount of the golf club shaft is 110 mm, when the golf club shaft is bent in one direction by applying a force from both sides of a grip end and a head end in a direction of shortening the length between the grip end and the head end while the grip end and the head end of a golf club are positioned on a shaft center axis. That is, the three kinds of golf clubs are different from each other in a ratio (percentage) of a distance from the golf club grip end to the kick point position, with respect to the entire length of the golf club shaft. The position of the kick point of each of the three kinds of golf clubs may be measured for each golf club, for example, by a shaft bending characteristics measurement apparatus described in JP 2003-310803 A, which was filed by the applicant of the present application.

Three kinds of golf clubs include a golf club having a golf club shaft with a kick point Low of the ratio of about 42%, a golf club having a golf club shaft with a kick point Mid of the ratio of about 43%, and a golf club having a golf club shaft with a kick point High of the ratio of about 44%. A plurality of golfers gripped and swung these three kinds of golf clubs respectively, and selected a golf club with which the feeling (hit feeling) was most preferable from the three kinds of golf clubs.

In FIG. 8, the head speed of a golfer who has selected a kick point High is in a range of 39 m/s to 52 m/s, the head speed of a golfer who has selected a kick point Mid is in a range of 40 m/s to 49 m/s, and the head speed of a golfer who has selected a kick point Low is in a range of 40 ms/ to 52 m/s.

Thus, it is understood that the kick point of a golf club shaft selected by each golfer is not directly related to a head speed.

As described above, the speed of a grip end during a golf swing characterizes the behavior of a golf club during a golf swing. When golfers having selected the kind of each kick point are classified in accordance with a value ($V_h/V_g$) obtained by dividing the head speed $V_h$ at a time of an impact by the grip end speed $V_g$, as shown in FIG. 8, the golfer having selected a kick point High has an average of the value $V_h/V_g$ of 8.0, the golfer having selected a kick point Mid has an average of the value $V_h/V_g$ of 10.3, and the golfer having selected a kick point Low has an average of the value $V_h/V_g$ of 12.0.

Thus, it is understood from FIG. 8 that the golfer having selected a golf shaft with a kick point High has a smaller value $V_h/V_g$, compared with the golfer having selected golf club shafts with a kick point Low and a kick point Mid, and that the golfer having selected a golf club shaft with a kick point Low has a larger value $V_h/V_g$. The value ($V_h/V_g$) obtained by dividing the head speed $V_h$ at a time of an impact by the grip end speed $V_g$ is considered to characterize the behavior of a golf club during a golf swing.

Accordingly, a golf club shaft can be selected based on the value obtained by dividing the head speed $V_h$ at a time of an impact by the grip end speed $V_g$ as an index for selecting a golf club shaft.

By selecting a golf club shaft as described above, a golf club fitting for each golfer can be selected objectively without depending upon a fitter.

For example, in the case where the above-mentioned value $V_h/V_g$ is 10.0±1.0, a golf club having a golf club shaft with a kick point Mid with the ratio of about 43% in a golf club shaft at a kick point position may be selected. Furthermore, in the case where the value $V_h/V_g$ is 12.0±1.0, a golf club having a golf club shaft with a kick point Low of the ratio of about 44% may be selected. Furthermore, in the case where the average of the value $V_h/V_g$ is 8.0±1.0, a golf club having a golf club shaft with a kick point High of the ratio of about 42% may be selected.

Furthermore, in the case where a golf club is selected, taking into a further serious consideration the ratio between the movement speed at a grip position and the movement speed at a head position in the impact state, for example, in the case where the above value $V_h/V_g$ is 8.0±2.0, a golf club having a golf club shaft with a kick point High may be selected. In the case where the value $V_h/V_g$ is 16.0±2.0, a golf club having a golf club shaft with a kick point Low is selected. In the case where the value $V_h/V_g$ is 12.0±2.0, a golf club having a golf club shaft with a kick point Mid may be selected.

According to the method of selecting a golf club of the present invention, as the value $V_h/V_g$ is larger, a golf club having a golf club shaft with a kick point Lower may be selected. As the value $V_h/V_g$ is smaller, a golf club having a golf club shaft with a kick point Higher may be selected. There is no particular limit to the selection criteria.

In the above embodiment, the time series movement speed histories during a golf swing at each of the grip position and the head position were calculated by the three-dimensional position direction measurement apparatus 12 using a magnetic sensor. Then, the grip end speed $V_g$ and the head speed $V_h$ at a time of an impact were extracted from the time series movement speed histories, and a golf club suitable for the swing of each golfer was selected in accordance with the value ($V_h/V_g$) obtained by dividing the head speed $V_h$ by the grip end speed $V_g$ at a time of an impact. According to the method of selecting a golf club of the present invention, the method of obtaining the head speed $V_h$ and the grip end speed $V_g$ at a time of an impact are not limited to the use of the three-dimensional position direction measurement apparatus using a magnetic sensor as in this embodiment. According to the present invention, the information on the head speed $V_h$ and the grip end speed $V_g$ at a time of an impact (in an impact state) may be obtained, for example, as in a second embodiment shown below.

Figure 9:
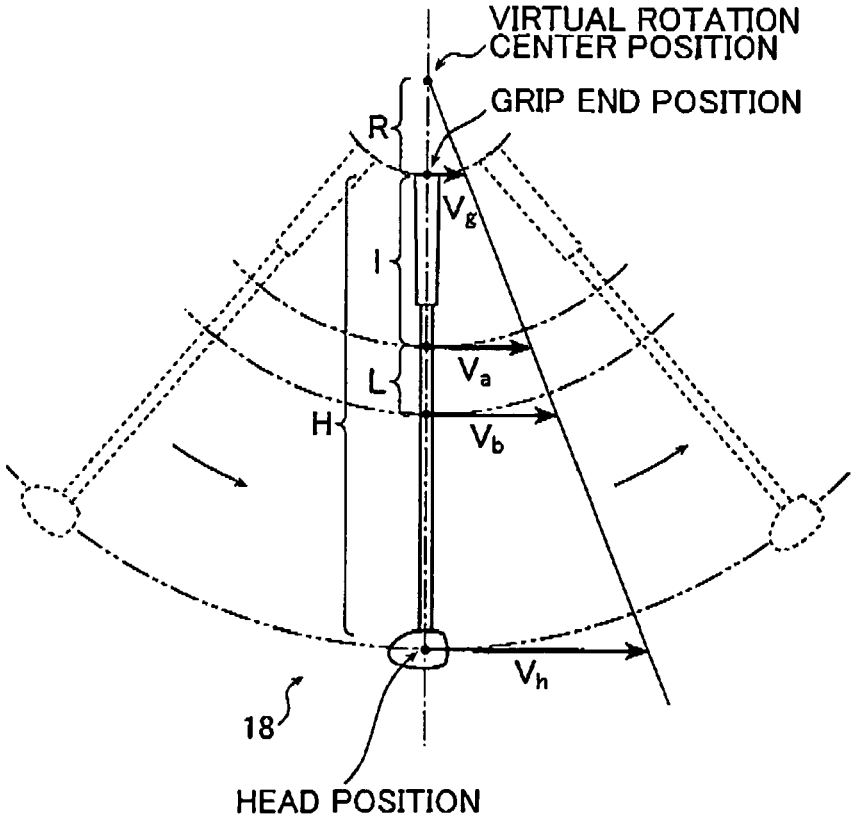
FIG. 9 is a diagram illustrating an example of a method of measuring a head speed $V_h$ and a grip end speed $V_g$ in an impact state, without using a three-dimensional position direction measurement apparatus, during a golf swing.

FIG. 9 is a diagram illustrating another embodiment (second embodiment) of a method of measuring the head speed $V_h$ and the grip end speed $V_g$. in an impact state of a golf swing. In the second embodiment, movement speeds $V_a$ and $V_b$ at two measurement positions on a golf club, different from the grip position and the head position, in an impact state of a golf swing are respectively measured. Then, the head speed $V_h$ and the grip end speed $V_g$ in an impact state are calculated from the movement speed at these two measurement positions in an impact state.

In the second embodiment, a golfer grips and swings a golf club, and the movement speeds $V_a$ and $V_b$ at two measurement positions on a golf club shaft of the golf club are measured. The movement speeds $V_a$ and $V_b$ (represented by a speed vector $V_a$ and a speed vector $V_b$ in FIG. 9) are speeds in a direction substantially parallel to the ground on which the golfer stands. The movement speeds $V_a$ and $V_b$ at two measurement positions on the golf club can be measured in a non-contact manner using a laser and a camera. The measurement of the movement speeds at two measurement positions on a golf club shaft can be performed using the speed measurement apparatus of a movement object, and the like disclosed by JP 2005-076309, JP 2005-076485, and JP 2005-076310 A, which were filed by the applicant of the present application.

For example, two line-shaped laser beams are emitted from the front side of the golfer at two locations where the golf club shaft passes by just before the impact state, the line-shaped laser beam casting in the vertical direction to the ground. The golf club shaft has small reflection patches attached thereon at two measurement positions for reflecting the laser beams. Thereby, the reflected laser beams from the patches at the two measurement positions are detected at the two locations by a detection sensor such as a photo sensor. The time difference of the detection times of each reflected laser beam between the two locations is measured to calculate the movement speed at each measurement position.

In the second embodiment, the movement at an arbitrary position (grip position, head position, above-mentioned two measurement positions, etc.) on a golf club shaft during a golf swing is approximated by the movement of a substantially circular track with respect to a particular position (virtual rotation center position) on an extension line of the center axis of the golf club shaft. The magnitude (head speed $V_h$) of the head speed vector $V_h$ and the magnitude (grip end speed $V_g$) of the grip end speed vector $V_g$ in a direction substantially parallel to the ground on which the golfer stands can be respectively represented by the magnitude (movement speed $V_a$) of the speed vector $V_a$ and the magnitude (movement speed $V_b$) of the speed vector $V_b$ from the geometrically similar relationship. Each of the head speed $V_h$ and the grip end speed $V_g$ can be represented by a distance R from the virtual rotation center position to the evaluation position (grip position) of a grip end of a golf club, a distance 1 from the measurement position (position corresponding to the speed vector $V_a$) on the grip end side among the above two measurement positions to the grip position, an interval L between the two measurement positions, a distance H from the grip position of the golf club to the head position of the golf club head portion (1143 mm: about 45 inches), the magnitude of the speed vector $V_a$ (movement speed $V_a$), and the magnitude of the speed vector $V_b$ (movement speed $V_b$).

Specifically, the distance to the virtual rotation center position and to the evaluation position of a grip end of a golf club can be represented by the following Expression (4), and the grip end speed $V_g$ and the head speed $V_h$ can be represented by the following Expressions (5) and (6).

$$R=\{(V_a-V_b)\times 1+L\times V_a\}/(V_b-V_a) \quad (4)$$

$$V_g=(V_a\times R)/(R+1) \quad (5)$$

$$V_h=\{V_a\times(R+H)\}/(R+1) \quad (6)$$

The head speed $V_h$ and the grip end speed $V_g$ can be respectively calculated by Expressions (1) and (2) from the above Expressions (4) to (6).

$$V_g=\{(L+1)\times V_a-1\times V_b\}/L \quad (1)$$

$$V_h=\{(L+1-H)\times V_a+(H-1)\times V_b\}/L \quad (2)$$

Furthermore, the above ($V_h/V_g$) can be represented by the following Expression (7) from the above Expressions (1) and (2).

$$(V_h/V_g)=\{(L+1-H)\times V_a+(H-1)\times V_b\}/\{(L+1)\times V_a-1\times V_b\} \quad (7)$$

In the second embodiment, as described above, the movement speeds $V_a$ and $V_b$ at two arbitrary points on a golf club are respectively measured, and the head speed $V_h$ and the grip end speed $V_g$ at a time of an impact are calculated from these two movement speeds.

Regarding the head speed of a golf club during a golf swing, conventionally, simple measurement equipment using a laser and magnetism has been used. However, unlike the head, the passage portion of the grip is not constant, and the grip is covered with the hands of a golfer. Therefore, it is difficult to measure the grip speed during a golf swing. In the present invention, as in each of the above-mentioned embodiments, the movement speed of a grip end in an impact state of a golf swing can be obtained with high precision, by using a magnetic sensor measuring the behavior of a grip end in a time series and a speed measurement apparatus measuring the movement speeds at arbitrary two points on a golf club.

In each of the above-mentioned embodiments, a golf club shaft is selected based on the head speed and the grip end speed in an impact state, as basic measures for selecting a golf club shaft. However, the present invention is not limited thereto, and the speed history of a grip end and the speed history of a golf club head can be used as basic measures for selecting a golf club shaft.

Generally, during a golf swing, in a period from a top state to an impact state, a golf club head following a golf club shaft which precedes, and thereafter, a golf club shaft is deformed in a direction in which a golf club head precedes.

More specifically, when a downswing starts from the top state, the golf club moves in a substantially oval shape with respect to the grip. Therefore, when the speed applied to the grip increases, due to the influence of the golf club head that is an end portion of the golf club on a side opposite to the grip, the golf club shaft once bends in a negative direction with respect to the golf swing. After this, when the speed of the grip decreases, the golf club head bends in a positive direction with respect to the golf swing in an attempt to maintain the speed applied thereto.

The inventors of the present invention of the present application have found that this deformation has a high correlation with the speed history of the grip end of the golf club.

Thus, a golf club shaft having different kinds of kick points can be selected based on the speed history of the grip end.

More specifically, examples of the characteristics values of a golf swing obtained from the speed history of the grip end include a maximum speed $V_{max}$ of the grip end, a difference speed between the maximum speed $V_{max}$ of the grip end and a speed $V_{imp}$ of the grip end in an impact state, an average acceleration $A_{max}$ of the grip end, where speed increases in a period from the top state to the state of $V_{max}$, and an average acceleration $A_{imp}$ of the grip end, where speed decreases in a period from the $V_{max}$ state to the impact state. A golf club shaft may be selected from golf club shafts having different kinds of kick points based on each of these characteristics values or an index obtained by combining a plurality of characteristic values.

Referring to FIG. 4, the maximum speed $V_{max}$ of the grip end is 12 m/s, and the speed $V_{imp}$ of the grip end in an impact state is 3 m/s. Therefore, the difference between the maximum speed $V_{max}$ of the grip end and the speed $V_{imp}$ of the grip end in an impact state becomes 9 m/s (=12 m/s−3 m/s).

Furthermore, the average acceleration $A_{max}$ of the grip end, which increases in a period from the top state to the $V_{max}$ state is 60 m/s$^2$ (=12 m/s÷0.2 s), and the average acceleration $A_{imp}$ of the grip end, which decreases in a period from the $V_{max}$ state to the impact state is 90 m/s$^2$ (=9 m/s ÷0.1 s).

The deformation of a shaft has also a high correlation with the speed history of the golf club head. Thus, a golf club shaft can be selected based on the speed history of the golf club head. More specifically, examples of the characteristics values of a golf swing obtained from the speed history of the golf club head include a maximum speed $V_{hmax}$ of the golf club head up to an impact state and a speed $V_{himp}$ of the golf club head in an impact state, and a speed $V_{hgmax}$ of the golf club head at a time when the grip end becomes the maximum speed $V_{max}$. From these characteristics values, a golf club may be selected based on the acceleration of the golf club head immediately before the impact and the average golf club head acceleration from the top state to the impact state.

Furthermore, in the above embodiments, although a golf club shaft is selected from golf club shafts having different kinds of kick points based on the head speed and the grip end speed at a time of an impact, the present invention is not limited thereto.

A golf club shaft to be selected is not limited to a golf club having a desirable kind of a kick point. A golf club shaft having a desirable flex of a golf club shaft may be selected.

Furthermore, a golf club shaft can also be selected as follows. The optimum length of a golf club shaft during a golf swing is selected from the head speed of a golf club, then the optimum kick point of the golf club shaft during a golf swing is determined from the speed history of the grip end, whereby a golf club shaft can be selected.

More specifically, a golf club fitting for a certain golf swing may be selected by using the speed history in the vicinity of the grip end with another method of selecting a golf club.

Furthermore, in the above embodiments, the golf swing analysis system is realized by the three-dimensional position direction measurement apparatus, the processing apparatus 14, the operation apparatus 15, and the display apparatus 16, and the three-dimensional position direction measurement apparatus obtains the position and the direction of a golf club using a magnetic sensor. However, the present invention is not limited thereto.

The three-dimensional position direction measurement apparatus only needs to be capable of measuring the position and the direction of a golf club during a golf swing. The three-dimensional position direction measurement apparatus may be an apparatus capable of subjecting an image captured with a video camera or the like to particular image processing, and point-tracking the golf club, thereby measuring the position and the direction of a golf club.

Furthermore, according to the present invention, the processing apparatus 14 may obtain the previously measured position and direction of a golf club without using the measurement apparatus for measuring the position and the direction of the golf club during a golf swing.

For example, the position and the direction of the golf club are previously measured, and the information on the position and the direction of the golf club is stored in a portable storage medium. This information is read from the storage medium by the processing apparatus 14, whereby the information on the position and direction of the golf club can be obtained.

Alternatively, the information on the previously measured position and direction of a golf club is stored in a database or the like, and the processing apparatus 14 can also obtain information on the position and the direction of a golf club via a network from the database.

In the above embodiments, the three-dimensional position and the direction thereof are obtained at the golf club head at an arbitrary position away from the grip end to the golf club head side by 700 mm or more (1143 mm in the above embodiments) along the golf club shaft axis, and at the grip end in the vicinity of the end of the grip. However, the present invention is not limited thereto. The three-dimensional position and the direction thereof at two predetermined different positions along the golf club shaft axis may be obtained. In this case, a receiver (magnetic sensor) is fixed at one measurement point along the golf club shaft axis, and data on the three-dimensional position and the direction thereof at the other measurement point can be calculated based on the data.

In the above embodiments, at the measurement point of the golf club head, the three-dimensional position and the direction thereof are calculated based on the data on the three-dimensional position of the grip end and the direction thereof. However, apart from the receiver (magnetic sensor) of the grip end, a receiver (magnetic sensor) may be fixed at a measurement point of the golf club head, and the three-dimensional position and the direction thereof in the golf club head may be obtained.

A method of selecting a golf club according to the preset invention has been described in detail. However, the present invention is not limited to the above embodiments, and various improvements and modifications may be made thereto without departing from the spirit of the present invention.

What is claimed is:

1. A golf club selecting method of analyzing a behavior of a golf club during a golf swing performed with the golf club gripped by a golfer, the golf club having a shaft length of 1066 to 1219 mm, a frequency of 3.3 to 5.0 Hz, and a mass of 280 to 320 g, and selecting a golf club in accordance with the golf swing, comprising:

a swing information acquiring step of obtaining time series data on a position and a direction of a grip end of the golf club during the golf swing performed by the golfer gripping the golf club by a three-dimensional position direction measurement apparatus, and calculating a movement speed of a grip position corresponding to the grip end of the golf club and a movement speed of a head position corresponding to a head portion of the golf club in an impact state immediately before a golf ball is hit with the golf club based on the time series data on the grip end of the golf club by a processing apparatus, the three-dimensional position direction measurement apparatus that includes a transmitter, a receiver, and a controller, wherein the transmitter forms a magnetic field with a known distribution regarding an intensity and a direction within a movement range of the grip end of the golf club in the golf swing, the receiver is fixed at the grip end of the golf club for sensing magnetism in the magnetic field and for outputting a signal in accordance with a three-dimensional position with respect to a predetermined reference position and a direction with respect to a predetermined reference direction, and the controller generates time series data on the grip position in a three-dimensional space and time series data on a direction, based on the signal output from the receiver when the golf swing is performed using the golf club in the formed magnetic field; and a golf club selecting step of obtaining a value by dividing the movement speed of the head position by the movement speed of the grip position, displaying the value on a screen of a display apparatus as information for selecting a golf club from a plurality of golf clubs, each golf club having a golf club shaft and each golf club shaft having a different kick point, and selecting a golf club having a golf club shaft of a high kick point from the plurality of golf clubs when the displayed value is less than 10.0, selecting a golf club having a golf club shaft of a low kick point from the plurality of golf clubs when the displayed value is 14.0 or larger, or selecting a golf club having a golf club shaft of a mid kick point from the plurality of golf clubs when the displayed value is 10.0 or larger and less than 14.0.

2. The golf club selecting method according to claim 1, wherein the movement speed of the grip position in the impact state and the movement speed of the head position in the impact state are respectively calculated by the processing apparatus based on movement speeds of measurement positions in the impact state obtained by measuring movement speeds in the impact state at two measurement positions placed between the grip position and the head position on a shaft of the golf club.

3. The golf club selecting method according to claim 2, wherein, assuming that an interval distance of the two measurement positions on the shaft of the golf club is L, a distance from one measurement position on the grip position side of the two measurement positions to the grip position is 1, an interval distance between the grip position and the head position is H, a movement speed in the impact state at the one measurement position is $V_a$, and a movement speed in the impact state at the other measurement position is $V_b$, a movement speed $V_g$ in the impact state at the grip position is calculated by the processing apparatus using the following Expression (1), and a movement speed $V_h$ in the impact state at the head position is calculated using the following Expression (2):

$$V_g=\{(L+1)\times V_a 1\times V_b\}/L \quad (1)$$

$$V_h=\{(L+1-H)\times V_a+(H-1)\times V_b\}/L \quad (2).$$

4. The golf club selecting method according to claim 1, wherein the swing information acquiring step includes measuring the movement speed of the grip position corresponding to the grip end of the golf club and the movement speed of the head position corresponding to the head portion of the golf club based on an image obtained by capturing the golf swing by subjecting an image of the golf swing captured with a video camera to image processing and point-tracking the golf club on the processed image.

* * * * *